US006827137B2

(12) United States Patent
Repice et al.

(10) Patent No.: US 6,827,137 B2
(45) Date of Patent: Dec. 7, 2004

(54) AIRFLOW/CIRCULATING DESIGN FOR ONE-ROW HEAT EXCHANGER

(75) Inventors: Christopher G. Repice, Camillus, NY (US); Paul S. Sacks, Cazenovia, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/321,763

(22) Filed: Dec. 17, 2002

(65) Prior Publication Data

US 2004/0112574 A1 Jun. 17, 2004

(51) Int. Cl.[7] ..... F28D 1/047
(52) U.S. Cl. ..... 165/150; 62/515; 165/124
(58) Field of Search ..... 165/150, 151, 165/120, 121; 62/515, 524

(56) References Cited

U.S. PATENT DOCUMENTS 1,914,197 A * 6/1933 Davis, Jr. et al. ..... 165/151
4,272,969 A * 6/1981 Schwitzgebel ..... 62/419
5,755,282 A 5/1997 Teshima et al.
6,460,372 B1 10/2002 Fung et al.

FOREIGN PATENT DOCUMENTS

| | | | |
|---|---|---|---|
| EP | 1 258 375 | 11/2002 | |
| FR | 633229 | * 1/1928 | ..... 165/151 |
| GB | 2 013 316 | 8/1979 | |

* cited by examiner

*Primary Examiner*—Allen J Flanigan
(74) *Attorney, Agent, or Firm*—Wall Marjama & Bilinski LLP

(57) ABSTRACT

In a single row evaporator coil having a last tube receiving refrigerant in a superheated condition, at least one baffle is provided to divert the flow of air passing over the superheat tube such that it also passes over a nonsuperheat tube so that air can be dehumidified by the cooling effect of the nonsuperheat tube prior to the air being passed downstream.

6 Claims, 2 Drawing Sheets

AIRFLOW/CIRCULATING DESIGN FOR ONE-ROW HEAT EXCHANGER

BACKGROUND OF THE INVENTION

This invention relates generally to air conditioning systems and, more particularly to an evaporator coil having a single row of tubes.

An evaporator coil is ordinarily made up of a plurality of sections, with each section having two or more rows of tubes. The tubes are commonly interconnected at their ends by return bends such that one or more circuits are formed with a plurality of interconnected tubes such that, with the introduction of refrigerant into a first tube, the refrigerant flows successively through the tubes until it reaches a last tube, after which the refrigerant flow then passes out of the coil and is made to flow to the compressor.

An air conditioning system is so designed that the refrigerant passing into successive tubes gets progressively evaporated, and when it reaches the last tube, it is in a superheated vapor condition. The purpose of this is to protect the compressor by preventing any liquid refrigerant from passing to the compressor.

It is recognized that superheat tubes can potentially be above the air dew point temperature. Accordingly, humid air passing over the superheat tube is not dehumidified as is the air passing over the other non superheated tubes. If nondehumidified air is allowed to pass through the heat exchanger, it may cause a fogging effect downstream thereof. That is, as the high humidity air mixes with cold air downstream, fog can be generated, or condensation can form on cold surfaces. The result may be that fog and/or water is then blown into the conditioned space. With a coil of two or more rows, this problem is overcome by the fact that the air passing over the superheat tube has passed or will pass over a nonsuperheated tube from another row. Thus the air passing over the superheated tube is dehumidified by a nonsuperheated tube, and the fogging problem is averted.

For purposes of reducing cost and weight, it would be desirable to replace a multi-row, low fin density coil with a single row, high fin density coil. However, since there is no adjacent unsuperheated tube to dehumidify the air passing over the superheated tube, the problem of fog generation is present.

It is therefore an object of the present invention to provide an improved single row coil.

Another object of the present invention is the provision for overcoming the problem of fogging in a single row coil.

Yet another object of the present invention is the provision for reducing the flow of non-dehumidified air from a single row coil.

Still another object of the present invention is the provision for a single row coil which is economical to manufacture and effective and efficient in use.

These objects and other features and advantages become readily apparent upon reference to the following descriptions when taken in conjunction with the appended drawings.

SUMMARY OF THE INVENTION

Briefly, in accordance with one aspect of the invention, provision is made in a single row coil for the air flow to be diverted in such a way that the air being cooled and passing over a superheat tube in the circuit is also made to pass over a nonsuperheat tube such that the air is dehumidified prior to its passing downstream of the coil.

By yet another aspect of the invention, at least one baffle is placed near the heat exchanger superheat tube such that the incoming air flow is diverted to obtain the desired dehumidifying effect.

By yet another aspect of the invention, a pair of baffles are provided in the vicinity of the superheat tube, with one on each side of the tube row, and with the two being staggered such that the desired air flow diversion is obtained.

By still another object of the present invention, the diversion of air can be such that the air passes first over the superheat tube and then over a nonsuperheat tube or first over a nonsuperheat tube and then over a superheat tube.

In the drawings as hereinafter described, a preferred embodiment is depicted; however, various others modifications and alternate constructions can be made thereto without departing from the true sprit and scope of the invention.

DESCRIPTION OF THE PREFERRED EMBODIMENT

Figure 1:
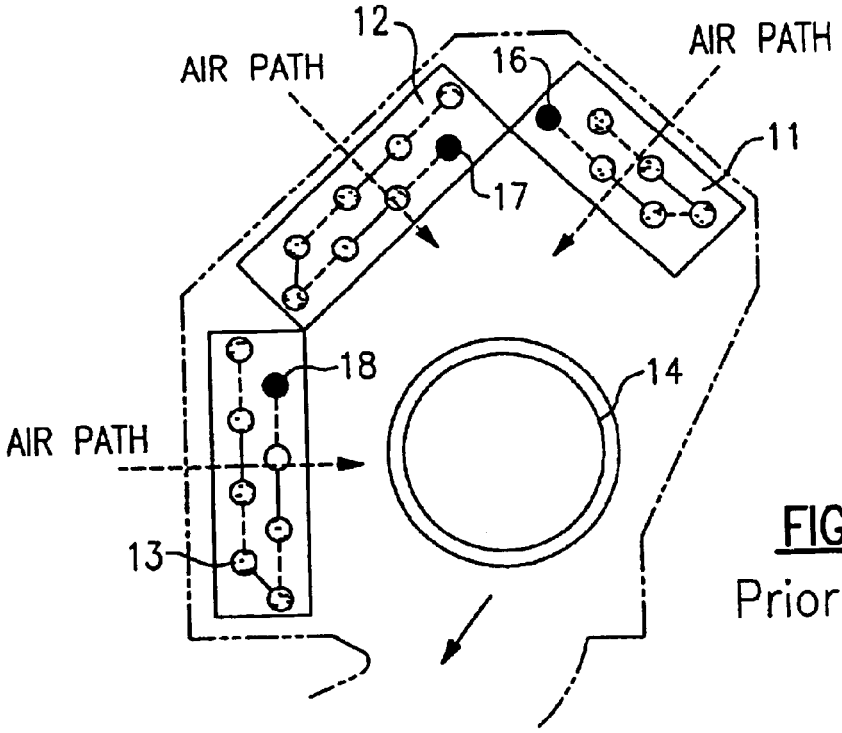
FIG.1 Prior Art
FIG. 1 is a schematic illustration of a conventional two-row coil system with the pattern of air flow shown.

Referring now to FIG. 1, a two-row coil system is shown with three sections 11, 12 and 13, with each section having two rows of tubes as shown. Within each section, refrigerant is caused to flow between successive tubes, with the refrigerant quality progressively increasing (i.e. evaporating) in each tube. That is, as the fan 14 draws air through the sections as indicated by the arrows, the air is cooled by the cooler refrigerant in the tubes, and conversely the refrigerant is heated by the air. The system is designed such that the temperature of the two-phase refrigerant in the tubes is below the air dew point temperature in most of the tubes, but when it reaches the last tube in the section, the temperature of the refrigerant vapor is typically above the air dew point temperature. These last tubes are referred to as superheat tubes and are indicated by the number 16, 17 and 18 in the respective sections 11, 12 and 13.

The purpose of the superheat tubes is to ensure that the refrigerant passing to the compressor is in a superheated stage and not in a liquid or two-phase stage since the compressor may be damaged by liquid refrigerant. However, it is recognized that the cooling ability of the superheat tube is different from the nonsuperheat tubes in the coil. That is, when the warm humid air enters the coil, the nonsuperheat tubes have sufficient cooling capacity to also dehumidify the air passing through, whereas the superheat tubes, typically being above the air dew point temperature, are not capable of dehumidifying the air. Because of the two-row structure, this is not a problem since the air passing across the superheat tubes is previously passed over the nonsuperheat tubes where the air is dehumidified. The result is that all of the air passing downstream of the fan 14 is cold dry air.

Figure 2:
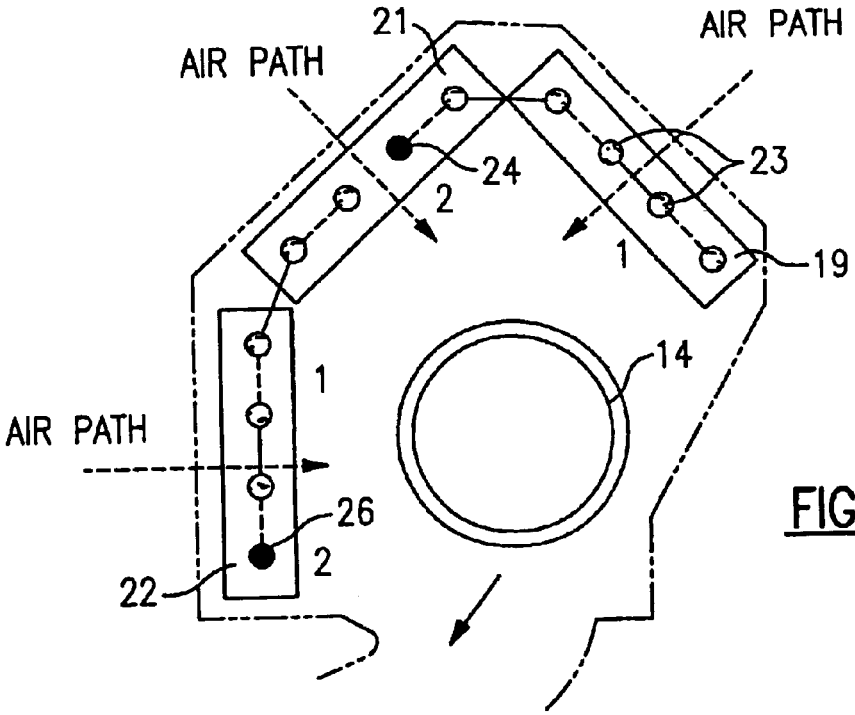
FIG. 2 shows a schematic illustration of a one-row coil system.
Figure 3:
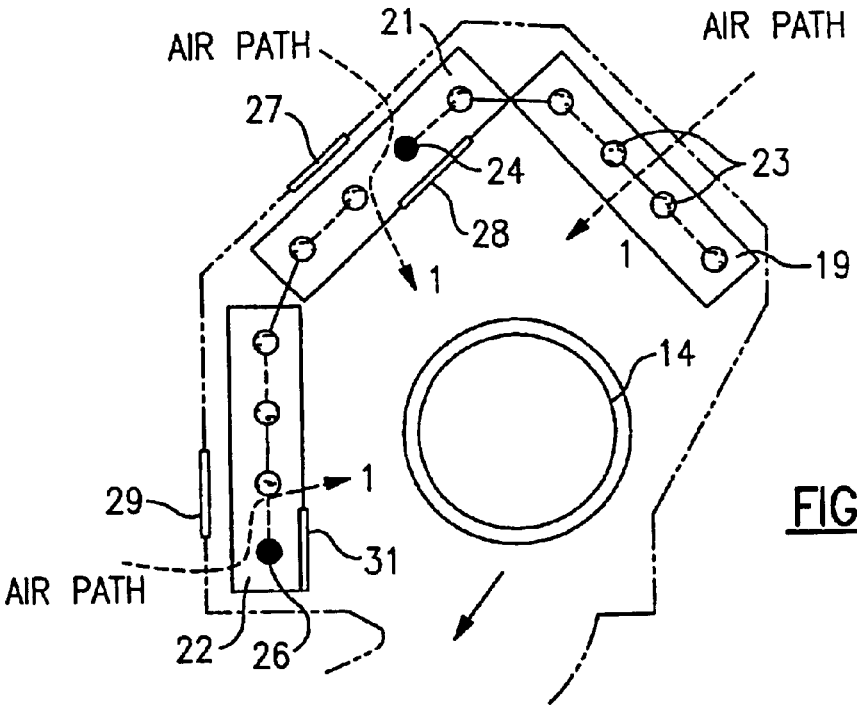
FIG. 3 is a schematic illustration of a one-row coil system with the present invention incorporated therein.

Considering now a coil with sections 19, 21 and 22 having a single row of tubes as shown in FIG. 2, it should be pointed out that there are only two circuits in the three sections, with one circuit starting in section 19 and ending in section 21, and with the other circuit starting in section 21 and ending in section 22. Here, the problem of having nondehumidified air can occur. That is, each of the nonsuperheat tubes 23 are sufficiently cool as to be capable of dehumidifying the air passing through the coil. But the superheat tubes 24 and 26 can, again, be above the air dew point temperature and therefore not capable of dehumidifying the air. Further, unlike in the two coil arrangement as described hereinabove, the air passing over the superheat tubes 24 and 26 does not pass over any of the nonsuperheat tubes 23. As a result, the air passing over the superheat tubes 24 and 26 is humid air which, when mixed with cold air downstream, can cause the generation of fog or the formation of condensate on cold surfaces. This can, in turn, cause fog or water to be blown into the conditioned space. This problem is addressed by the inventive arrangement as shown in FIG. 3.

In order to dehumidify the air passing over the superheat tubes 24 and 26 the air flow is diverted by a pair of baffles 27 and 28 in section 21 and baffles 29 and 31 in section 22. As will be seen, the baffle pairs are staggered in respect to their respective superheat tubes such that the air flow is redirected from the superheated tubes to an adjacent two phase tube to thereby further cool the air and thereby dehumidify it. This eliminates the previously described problem of fog and condensate formation caused by the mixing of cold, dry air with warmer humid air.

Figure 4:
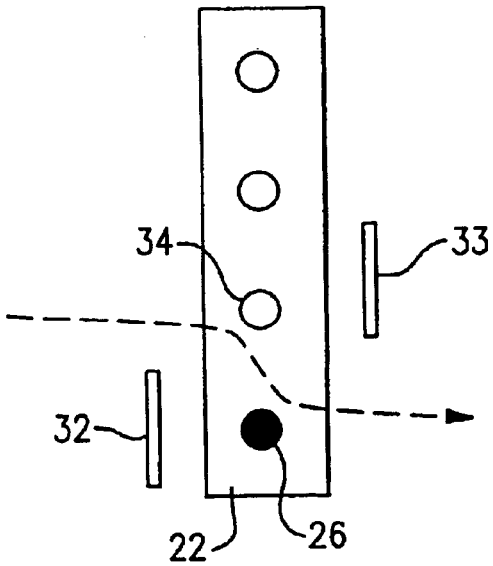
FIG. 4 is a schematic illustration of an alternative form of the present invention.

As an alternative to the above arrangement, wherein the air to be cooled flows first over the superheat tube 26 and then over the two phase tube, the baffles can be rearranged as shown at 32 and 33 of FIG. 4 wherein the air passes first over the two phase tube 34 and then over the superheat tube 26.

While the present invention has been particularly shown and described with reference to a preferred and an alternative mode as illustrated in the drawings, it will be understood by one skilled in the art that various changes in detail may be effected therein without departing from the spirit and scope of the invention as defined by the claims.

We claim:

1. An evaporator coil having a plurality of tubes and associated fins for the heat exchange flow of air thereover the coil comprising:

a single row only of tubes with adjacent tubes being interconnected at their ends by a return bend to form at least one serpentine circuit for conducting the flow of refrigerant from a first tube to a last tube, with the quality of the refrigerant progressively increasing and the temperature of the refrigerant in said last tube being superheated; and at least one baffle associated with said last tube for diverting the flow of air from a direction substantially normal to said row such that a substantial portion of the air passing first over said last tube subsequently passes over another tube.

2. An evaporator coil as set forth in claim 1 wherein said at least one baffle includes two baffles.

3. An evaporator coil as set forth in claim 2 wherein said two baffles are planar in form and are aligned substantially parallel to said tube row, with one on either side thereof.

4. A method of fabricating an evaporator coil having only a single row of tubes over which a flow of air to be cooled may pass in a direction substantially normal to the row, comprising the steps of:

constructing a refrigeration circuit with a plurality of tubes arranged in a row with adjacent tubes being interconnected by a return bend;

providing a means for introducing the flow of refrigerant in said tubes such that it flows from a first tube to a last tube; and providing at least one baffle to divert the flow of air to be cooled such that a substantial portion of the air passing first over said last tube subsequently passes over another tube.

5. A method as set forth in claim 4 wherein said baffle providing step includes that of providing two baffles with one on each side of said tube row.

6. A method as set forth in claim 5 wherein said baffles are placed in staggered relationship with one on each side of said tube row.

* * * * *